US006937140B1

(12) United States Patent
Outslay et al.

(10) Patent No.: US 6,937,140 B1
(45) Date of Patent: Aug. 30, 2005

(54) PERSONAL DIGITAL ASSISTANT KEY FOR AN ELECTRONIC LOCK

(75) Inventors: John Steven Outslay, Salem, OR (US); Wayne F. Larson, Salem, OR (US)

(73) Assignee: GE Interlogix, Inc., Salem, OR (US)

( * ) Notice: Subject to any disclaimer, the term of this patent is extended or adjusted under 35 U.S.C. 154(b) by 709 days.

(21) Appl. No.: 09/312,919

(22) Filed: Jun. 28, 1999

Related U.S. Application Data

(60) Continuation-in-part of application No. 08/846,040, filed on Apr. 25, 1997, now abandoned, which is a continuation-in-part of application No. 08/487,189, filed on Jun. 7, 1995, now Pat. No. 5,654,696, which is a division of application No. 08/099,743, filed on Jul. 30, 1993, now Pat. No. 5,475,375.

(51) Int. Cl.[7] ..... E05B 49/00
(52) U.S. Cl. ..... 340/5.73
(58) Field of Search ..... 340/825.31, 5.65, 340/5.51, 5.54, 5.32, 5.31, 5.23, 5.73; 235/382; 341/176, 23; 708/109, 135

(56) References Cited

U.S. PATENT DOCUMENTS

| | | | | | |
|---|---|---|---|---|---|
| 4,534,012 | A | * | 8/1985 | Yokozawa | |
| 4,727,368 | A | * | 2/1988 | Larson | 340/825.31 |
| 4,766,746 | A | * | 8/1988 | Henderson | 340/825.31 |
| 4,786,900 | A | * | 11/1988 | Karasawa et al. | 340/5.32 |
| 5,014,049 | A | * | 5/1991 | Bosley | 340/825.31 |
| 5,050,207 | A | * | 9/1991 | Hitchcock | 235/382 |
| 5,063,484 | A | | 11/1991 | Tanaka | |
| 5,245,652 | A | * | 9/1993 | Larson et al. | 340/825.31 |
| 5,254,652 | A | * | 10/1993 | Reimann | 340/825.31 |
| 5,280,518 | A | * | 1/1994 | Danler | 379/100 |
| 5,475,375 | A | * | 12/1995 | Barrett | 340/825.31 |
| 5,644,516 | A | | 7/1997 | Podwalny et al. | |
| 5,654,696 | A | * | 8/1997 | Barrett | 340/825.31 |
| 5,715,524 | A | | 2/1998 | Jambhekar et al. | |
| 5,745,044 | A | * | 4/1998 | Hyatt et al. | 340/5.23 |
| 5,766,794 | A | | 6/1998 | Brunette et al. | |
| 5,778,256 | A | * | 7/1998 | Darbee | 341/176 |
| 5,793,032 | A | * | 8/1998 | Bard et al. | |
| 5,848,298 | A | | 12/1998 | Steere, Jr. et al. | |
| 5,867,140 | A | | 2/1999 | Rader | |
| 5,890,997 | A | | 4/1999 | Roth | |
| 6,484,176 | B1 | | 11/2002 | Sealand et al. | |

OTHER PUBLICATIONS

Microsoft Press Computer Dictionary, 1991, p. 160.*

* cited by examiner

*Primary Examiner*—Edwin C. Holloway, III
(74) *Attorney, Agent, or Firm*—Klarquist Sparkman, LLP

(57) ABSTRACT

A mechanical interface (84) for a PDA (80) allows the PDA to be positioned in an operative relationship relative to an electronic lock or electronic lockbox (82). The mechanical interface allows the PDA to be used as a key (80) to actuate the lock, by transmitting signals from the PDA to the lock. The PDA retains its normal functionality as a general purpose computer, and the interface can also form part of a link between the PDA and a remote computer (88) and/or database (92).

11 Claims, 18 Drawing Sheets

PERSONAL DIGITAL ASSISTANT KEY FOR AN ELECTRONIC LOCK

RELATED APPLICATION DATA

This application is a continuation-in-part of application Ser. No. 08/846,040, filed Apr. 25, 1997 (now abandoned), which is a continuation-in-part of application Ser. No. 08/487,189, filed Jun. 7, 1995 (now U.S. Pat. No. 5,654,696), which is a divisional of application Ser. No. 08/099,743, filed Jul. 30, 1993 (now U.S. Pat. No. 5,475,375).

FIELD OF THE INVENTION

The present invention relates to electronic lock systems and palmtop computers, and more particularly relates to methods and systems in which electronic lock systems and palmtop computers can be used together.

BACKGROUND OF THE INVENTION

The present assignee's U.S. Pat. Nos. 5,654,696 and 5,475,375 disclose electronic security systems in which a palmtop computer is used as a key. In the detailed systems, no modification is made to the computer; the computer and lock communicate via standard infrared ports. The lock opens if the correct signals are exchanged.

While advantageous in many respects, the systems detailed in those patents have certain limitations. For one, the locks must have infrared interface capabilities. While such capabilities can be incorporated into new locks, the large installed base of existing locks without infrared capability cannot be used in such systems. (A sampling of such locks is shown in commonly-owned U.S. Pat. Nos. 4,727,368, 4,766,746, 5,280,518, 5,550,529, and 5,758,522.)

DETAILED DESCRIPTION

According to one aspect of the present invention, above-noted the infrared interface problem is overcome by retrofitting onto the back of a general purpose palmtop computer an electrical and physical interface mimicking that of an electronic key. (See, in this regard, the physical arrangements shown in the just-cited commonly owned patents, and in co-pending application Ser. No. 09/067,356.) By such arrangement, the palmtop can be used as a key for the just-cited locks.

In a particular embodiment, the general purpose palmtop is a PalmPilot unit (e.g. the PalmPilot III, PalmPilot V, or the radio-equipped PalmPilot VII). These units feature relatively large display screens, which also serve as touch-input devices. The display screens can be programmed to present visual interfaces modeled after those of conventional keys, facilitating user training. Users respond by interacting with the screen, e.g., by pressing buttons displayed on the screen.

Figure 1:
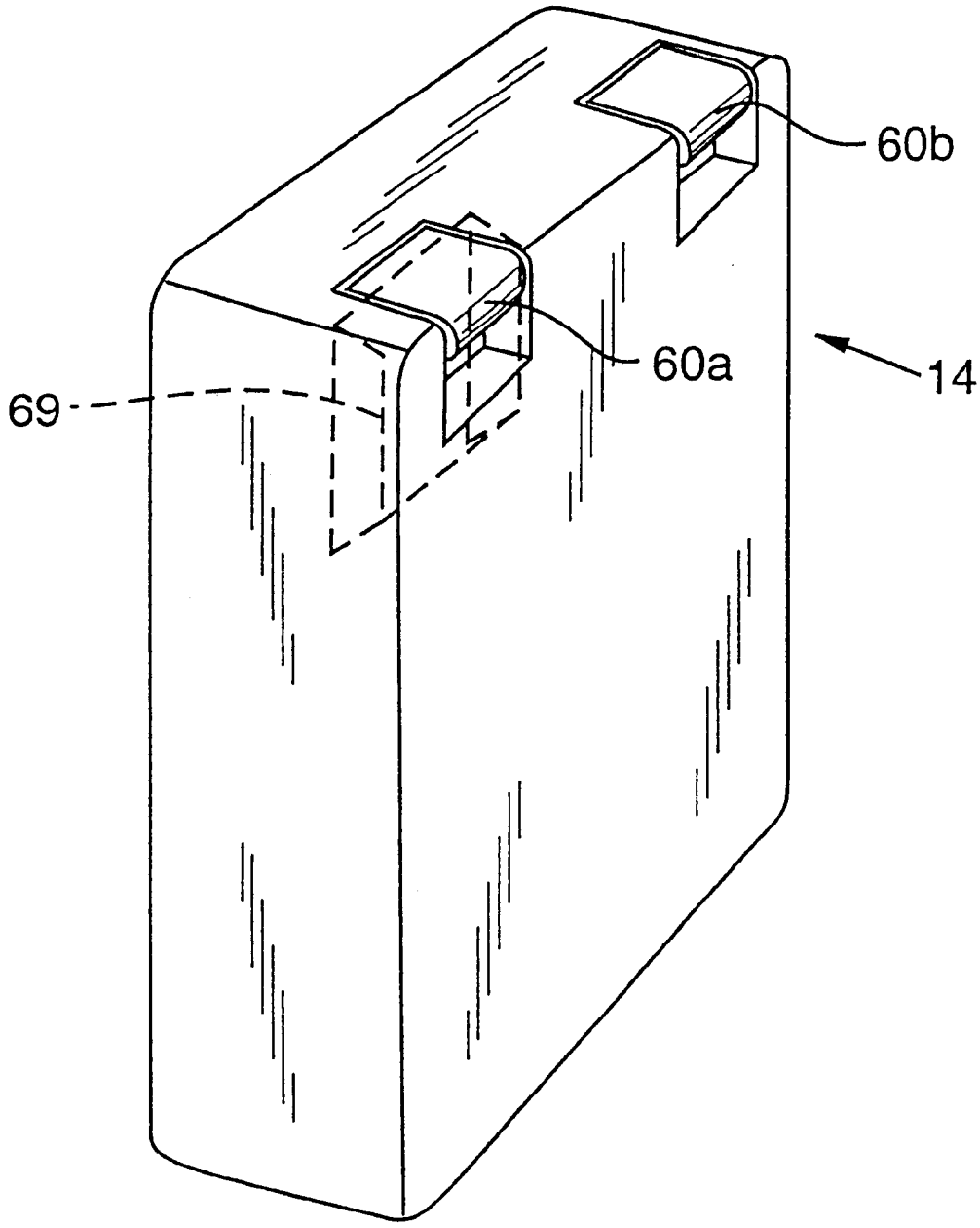
FIG. 1 shows a back of a modified palmtop computer according to one embodiment of the present invention.

In the preferred embodiment, the back of the PalmPilot unit is removed, and a new back (a portion of which is shown in FIG. 1) is installed to provide the mechanical and electrical components needed to interface with the electronic lock (e.g., one of the locks shown in the patents cited in the foregoing paragraph).

The mechanical configuration of the replacement back portion will depend on the particular palmtop being reconfigured, and the lock with which it is to be used. In the illustrated embodiment, the replacement back has a portion 14 extending therefrom that is sized to be received within a cooperating nest on the front of the lock. Electrical terminals 60*a*, 60*b* are provided to effect transfer of data between the palmtop and lock units (and optionally, to provide power from the palmtop to the lock).

Within the replacement back are drive electronics for the lock signals, and related lock-specific circuitry. While electronic keys typically include microprocessors and associated memories, the palmtop's processor and memory can be used for these purposes. Alternatively, a separate microprocessor and memory can be provided for key-specific functionality. Even in such alternative embodiment, however, the PalmPilot microprocessor is used for control of the display and touch screen. (The design of electronic keys is known to the artisans in the field, so key-specific details are not belabored here.)

Figure 2:
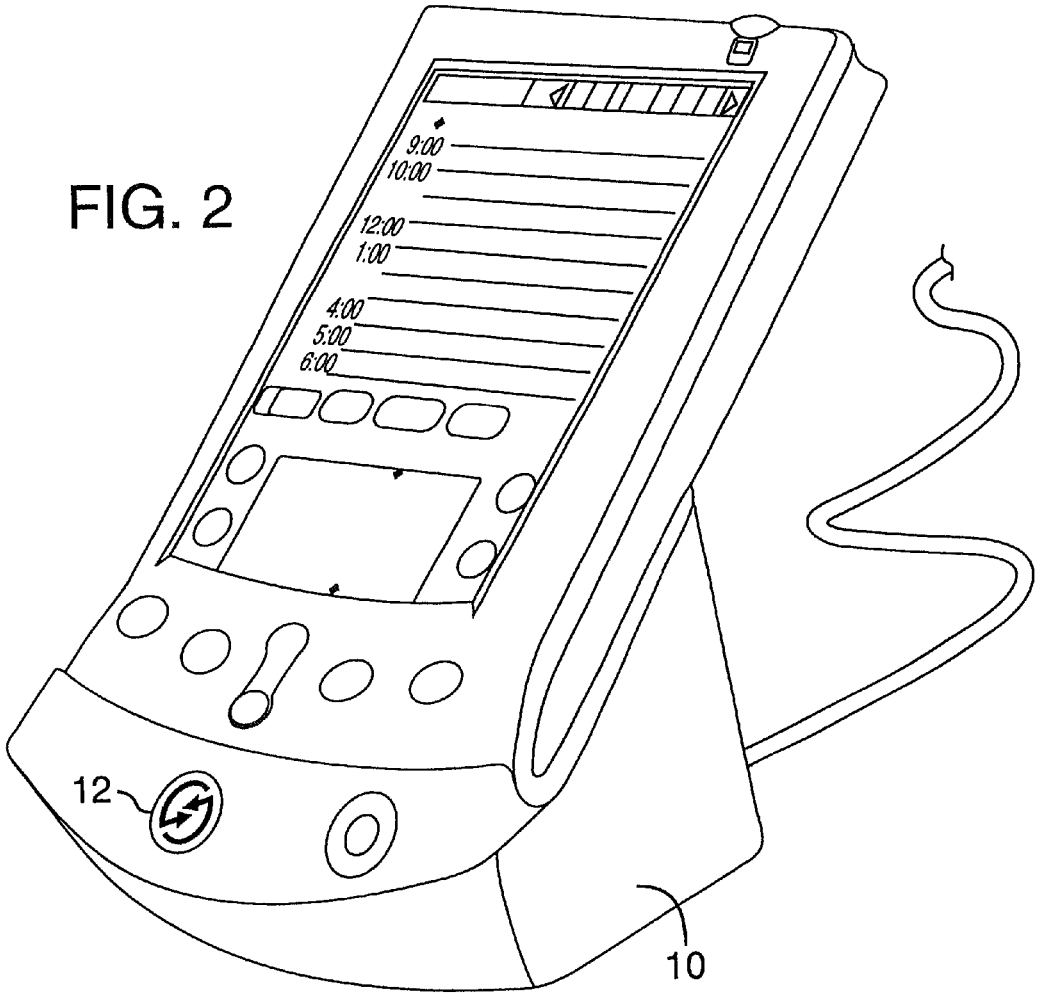
FIG. 2 shows a palmtop computer according to the present invention in a "nest."

In this exemplary embodiment, the palmtop is returned to a "nest" 10 (FIG. 2) every evening to recharge its batteries. Included in the nest is a two-way link to a remote clearinghouse. This link can be effected by radio or wired connection. A wired connection may couple to the remote clearinghouse over a dedicated or dial-up direct link, or over the internet. At a pre-programmed time each evening, the palmtop exchanges data with the remote clearinghouse. The palmtop's key functionality is desirably programmed to "expire" periodically, such as every 24 hours. When the palmtop communicates with the central clearinghouse, update data may be provided to the key to extend its life a further 24 hours (assuming the palmtop owner has paid whatever dues are owed to the governing realtor's association, and has not otherwise become disqualified from continued use of a key). By such arrangement, if the palmtop is not periodically linked to the clearinghouse, the palmtop loses its key functionality.

During the palmtop's nightly exchange with the central clearinghouse, the clearinghouse downloads to the key new data relating to the lock system. In the illustrated embodiment, the lock system is a real estate lockbox system (but the present technology can equally-well be applied to other types of lock systems, e.g., industrial site security systems). The data downloaded nightly thus includes profiles of new homes listed for sale ("new listings"). To reduce download time and memory consumption in the palmtop, only data about selected new listings is downloaded. For example, a user of the palmtop may define a profile identifying the types of new listings for which updates are desired. Such data can be defined in boolean fashion, using parameters familiar to real estate agents (e.g. within specified price ranges, neighborhoods, square footages, home age, amenities, etc.). Several such profiles can be defined. Each night, these profiles are compared against new listing data at the central clearinghouse to identify the data that should be relayed to the palmtop.

The process of defining the profiles can employ the palmtop and its user interface, in conjunction with a server computer at the central clearinghouse. If the central clearinghouse server supports internet access, a conventional internet browser can also be used from a desktop computer to interactively define desired profiles for a given user.

While the above-referenced downloading typically takes place during the night, the palmtop can be nested at any time, and an update can be invoked by suitable instructions to the palmtop and/or nest (e.g., by pressing a HotSync button 12 on the nest, launching the update process).

Data in addition to new listing data can be downloaded to the palmtop during the nightly sessions. For example, one or more screens of bulletins might be provided to the palmtop, providing information of interest to the users. These bulletins may be displayed when the palmtop is removed from the nest, or can be summoned to the display anytime during the day in response to user command.

The bulletins can include reminders of upcoming dues payments to the local realtor's association, notices of upcoming seminars of interest, daily quotations of mortgage interest rates, and other news topics of interest to real estate agents.

News of more general interest might also be included, such as current prices of favorite stocks, the day's weather report, etc.

Other bulletins may convey technical information relating to the lockbox system, such as hints for easier key usage, notices of scheduled upgrades, etc.

Other bulletins may take the form of advertising, e.g., by title insurance companies, real estate lawyers, mortgage brokers, etc.

Other bulletins may include data specific to the user, such as sales year-to-date, average time on market for user's listings, ordered lists of the homes listed for sale by the user ranked by their showing frequency (or the last-shown date), recent access information for homes listed for sale by the user (detailing, e.g., the address of the property, the listing number, the name of the showing real estate agent, the agent's telephone number, and the date/time of showing), etc.

Various software productivity tools are marketed to real estate professionals (e.g., Top Producer and a variety of electronic mapping products). Some of these can be run on palmtops. Desirably, data from the bulletins can be imported into these software tools, whether by cut/paste operations, or by more sophisticated known data exchange techniques. Such data can also be imported into standard productivity tools conventionally resident on palmtops (e.g., date book, address/phone book, e-mail, financial calendar, etc.)

As described in U.S. Pat. No. 5,654,696, the downloading of data to the palmtop is preferably not performed until the palmtop has first uploaded its activity data to the central clearinghouse. Such data is necessary in order for the clearinghouse to track which keys access which locks, and when.

In some variants, the palmtop is provided with an accessory (e.g., added with the retrofit back) to make electronic measurements of a room's dimensions using known techniques (e.g., based on acoustic wave techniques).

Figure 3:
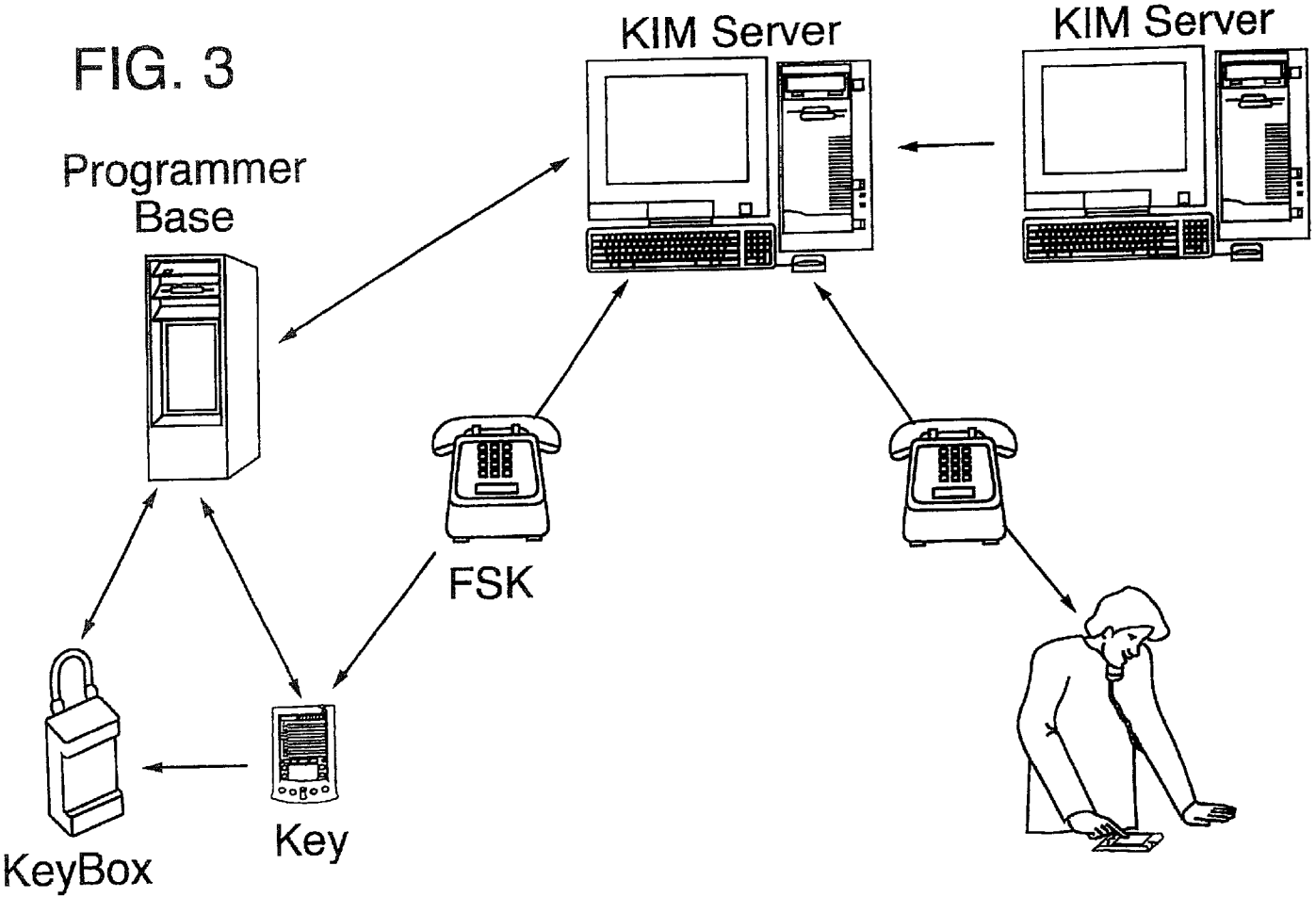
FIG. 3 is a network diagram showing a conventional AEII real estate lockbox system.

Below is a user specification for the AEIII system detailing the preferred embodiment and variations thereon. In these materials, KIM is the name given to the central clearing house, and KIMnet is given to the private network through which the clearing house communicates with the nests, etc. (Public networks can be used in other embodiments.) AEII is the Advantage Expressed II electronic real estate lockbox system marketed by the present assignee, and detailed in certain of the patents cited above (see also FIG. 3). AEII is the present assignee's next generation electronic real estate lockbox system (see also FIG. 4).

AEIII User Specification

The AEII "PDA/KeyBox" key will have the following functionality in addition to the current features found in the existing SuperKey. The AEIII "PDA/KeyBox" key will be:

(1) Fully compatible with the existing AEII KeyBox system, (2) Designed to take advantage of the planned features of the next generation AEIII KeyBox.

We envision a personal productivity tool that incorporates the following functions:

KeyBox functionality

Access to MLS data

Business communications

Personal productivity

Keybox Functionality

Board/MLS System Features—Security, Communication, Information

A real estate board (the "Board") or a MLS administrator has the option to "kill" (i.e., deactivate) keys on a daily (24-hour) basis.

The Board/MLS has the ability to communicate with all active keyholders on a daily basis using the broadcast bulletin board, as described in the Business Communications section below.

The Board/MLS has the ability to see the total showing activity on a daily basis and has password-controlled access to each keyholder's daily activity by the keybox serial number. The MLS is able to provide agents access to listing information without requiring the use of a PC, as described below in the Agent System Features section.

The Board/MLS may have a keybox that provides for a security level that is certified by an independent party (i.e., Underwriters Laboratory).

Agent System Features—Information, Productivity, Ease of Use

1. Automated Updates

Agents are not required to physically update their key on a monthly basis. When placed on the nest or hot sync stand 10, the PDA key will be automatically updated (provided status is "authorized") via the daily hot sync upload/download program.

The PDA key automatically notifies the agent (via a message on its own display)<if the key is "expired." This notification will take place whenever the PDA key is turned on.

2. Battery Maintenance

An agent's PDA key will have a rechargeable power source that is charged whenever the agent places the PDA key on the hot sync stand.

3. Keyholder Messages

The PDA key displays user and system error messages. Examples include "incorrect PIN code," "access not granted due to time of day lockout hours violation," "incorrect shackle code," "call before showing is on," etc. Shackle codes are the codes required to activate the lockbox shackle that secures the lockbox to an object, e.g., the doorknob of a door to a residence.

The PDA key notifies agents when their listings have been shown. If an agent's listing is shown the prior day, the agent receives a "you have showings" message when the PDA key is turned on. The agent is then able to display the showings that occurred the previous day by listing address, the agent who showed property, the showing agent's phone number, and the date and time the showing occurred. This information is downloaded as part of the daily hot sync upload/download program. Showings can be displayed by listing address, provided the listing agent has input the address into the listing agent's PDA key or the MLS broker load system has entered the serial number of the keybox and an interface with KIM exists.

4. FSK Transmissions

The tone transmission capability for downloading keybox showing information may work with both digital and analog cellular phones. The most recent five accesses will be downloaded. There is no need for downloading additional accesses because all agent activity is uploaded daily and then sorted by keybox serial number. Tone transmission capability is valuable when an agent must know exactly who showed a particular listing up to the current moment in time.

The agent has the ability to input all relevant keybox inventory data and programming information into the agent's PDA key. For example:

| Keybox # | Listing Address | Shackle Code | Time of Day Hours |
|---|---|---|---|
| 7300912 | 234 Elm Street | 4646 | 9:00 p.m. to 8:00 a.m. |
| 5420981 | 9876 Melody Ln. | 9870 | 24 hour access |

The above inventory and programming information is updated each time the agent elects to use the PDA key to reprogram a keybox.

5. New Showing Reports

As previously described, KIM downloads new showings for the agent's listings on a daily basis. Only the keybox serial number and date/time of showing are downloaded to the PDA key. The PDA key uses the keybox inventory file to match these showings by serial number to the keybox address contained in the PDA key. This allows the agent's key to then display a "new showing" report on the PDA display, giving it by listing address.

6. Custom Programming

The agent may use the PDA key to reprogram shackle codes. The existing shackle code must be input in order to update it to a new shackle code. After an agent reprograms a keybox, the KIM database will be automatically updated with the change during the daily hot sync upload/download program.

The agent may use the PDA key to reprogram the Time-of-Day keybox access hours. The shackle code must be input in order to change the access hours. When an agent reprograms a keybox, the KIM database will be updated with those changes during the daily hot sync upload/download program.

An agent may use the PDA key to turn "on" or "off" the Call Before Showing ("CBS") function. The agent will also be able to reprogram the CBS code of a particular keybox. When an agent reprograms that keybox, the KIM database will be updated with those changes during the daily hot sync upload/download program.

7. Showing-Activity Reports

Listing agents will be able to receive showing-activity reports for their listings without reading the keybox. As part of the daily hot sync upload/download process, the showing activity from every agent's PDA key will be sent to KIM and sorted by keybox serial number. Agents will be able to access/request showing reports of their listings in the following manner:

Voice reports

Internet access

Fax reports

MLS menu option

An agent's individual keybox access/showing activity will also be available. The agent activity is stored as part of the daily hot sync upload/download process. The agent activity can be accessed by the agent, the agent's broker or the Association in the following manner:

Voice reports

Internet access

Fax reports

Keybox activity reports will also be available at the listing. The user will use the existing keybox read function and use the speaker in the PDA key to transmit the most recent five accesses/showings. A voice report will then provide the names, offices, phone numbers and dates and times of access. A fax report could then be requested as well.

8. Immediate Showing Feedback

Listing agents will be able to read a keybox and immediately display the last five entries on the PDA key, including the showing agent's PDA serial number, and date and time of access. This function requires no FSK transmission and is not intended to identify the agent, but only determine if a keybox transaction took place during the timeframe than an incident occurred. If the agent name is required, the tone transmission function and the voice report option are used.

9. Infrared Capacity

The PDA/keybox key is designed with an infrared transmission capability allowing it to be used with an enhanced keybox. The enhanced keybox will have a UL listing, and will be smaller in size than the AEII keybox. Further, this keybox will allow a keybox activity report (including agent name and phone number) to be displayed on the PDA key at the listing, without transmission to the KIM system.

MLS Access Functions

Access to MLS System Information

Agents are able to automatically receive and optionally gain access to MLS information using the hot sync stand 10 and the daily upload/download program. A wireless communication protocol allows an enhanced PDA to make such communications wirelessly. MLS access can be accomplished as part of the automatic nightly download process. The agent initiates this process by placing the PDA key on the hot sync base or nest 10, or the process can be performed on demand by selecting the desired function and then placing the PDA key on the base or nest 10 and depressing the hot sync button 12. Information and functions that will be available are:

Agents' Personal Listings

A summary of the agent's personal listings is downloaded with selected fields, such as listing address, owner name, square footage, price, bedrooms, baths, days on the market, etc. The PDA database is updated during the nightly hot sync upload/download only when there is a change to the agent's listings.

Custom Listing/Information (Agents' Farm)

Agents may request a custom profile that will be programmed into their PDA key. This profile will determine what MLS data is downloaded into the PDA key as part of the daily hot sync upload/download process. The custom profile will contain new or changed listing information specific to pre-specified characteristics of the agent's territory or "farm." A profile sheet is filled out by the agent and entered into the PDA key during system implementation.

Examples of information contained in this profile would be listing number, listing address, price, square footage, number of bedrooms/baths, or listing information that has changed on an existing listing, assuming that the request for the information was contained in the profile selected by the agent during initial programming.

Listing Hot Sheet

With access to MLS System Information as described above, an agent can choose to be notified of all new listings. This hot sheet feature would allow the agent to be made aware of the most recent listings rather than having new listings roll up into the custom listing information described above.

Buyers Show

An agent may choose to initiate a search of the MLS database by selecting from a number of search fields. For instance, an agent could select a specific zone or market area, price range, square footage range, number of baths, bedrooms, etc. The agent then places the PDA key on the hot sync stand 10 and initiates an upload. The result of the search would then be downloaded to the PDA key for display by the agent. This function can be requested in an "off-line" mode by the agent inputting the request for information but not placing the PDA key on the base or nest 10 until a later time. In this instance, the information requested would be processed as part of the daily hot sync upload/download program.

Business Communications

1. Broker Bulletin Board

The broker has the ability to input information for display on the bulletin board of each agent's PDA key. The bulletin board can be updated at any time by the Broker via the Internet, and will be automatically downloaded to an agent's PDA key anytime the PDA key is placed on a hot sync stand 10. In addition to the Broker bulletin board, offices may also communicate with the agents assigned to that office via the PDA key using the same process.

2. Board/MLS Bulletin Board

The Board and/or the MLS will have the same capability to communicate with the member agents as described in the Broker Bulletin Board above.

3. Technical Administration Bulletin Board

The Technical Administrator of the network will have the ability to broadcast technical and user information through the network to agents' PDA keys. Examples may include helpful hits for using the system, technical support suggestions and guidelines, product promotions and listing technology trend updates.

4. General Bulletin Board

The Board or broker will be able to sell bulletin board space to an organization outside real estate channels. Such advertising will generate revenue for the Board or Broker and may defray the cost of the PDA key for members.

5. New Listing Board

The New Listing Board enables an office to communicate new listings that have occurred. This feature allows Brokers the ability to post listings to their agents before they appear in the MLS.

6. Public Information (Programmable Profiles)

The PDA key can also be programmed to receive daily downloads of information such as stock updates, tax schedules and updates, industry specific information, etc.

Agent Personal Productivity Tools

The agent will have full use of all existing PalmPilot standard application programs that are delivered with a PalmPilot V unit. These include:

- Date book (appointment scheduler that can display daily, weekly or monthly view screens and is equipped with reminder alarms)
- Address/phone book (program for filing and editing addresses and personal notes)
- Memo list (allows user to write messages that can be synchronized to computer applications, e.g., Microsoft Word)
- E-mail (receive and respond to electronic mail messages whenever the PDA key is placed onto the hot sync stand 10)
- Financial Calculator (calculate payment, interest and amortization)

Figure 4:
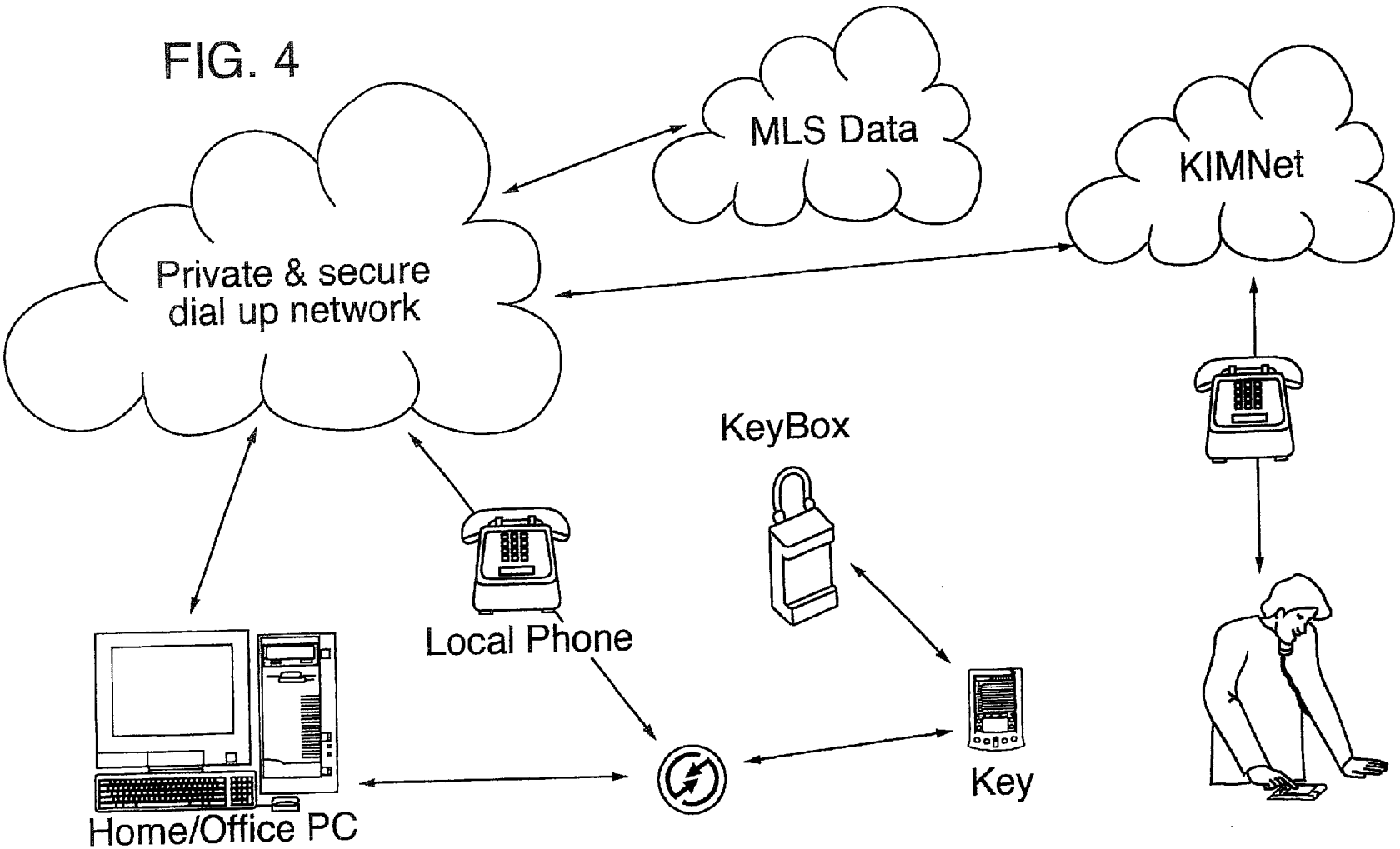
FIG. 4 is a network diagram showing a new AEIII real estate lockbox system.

These and other features are presented in bullet point form as follows:

Agent Benefits (FIG. 4)

Figure 5:
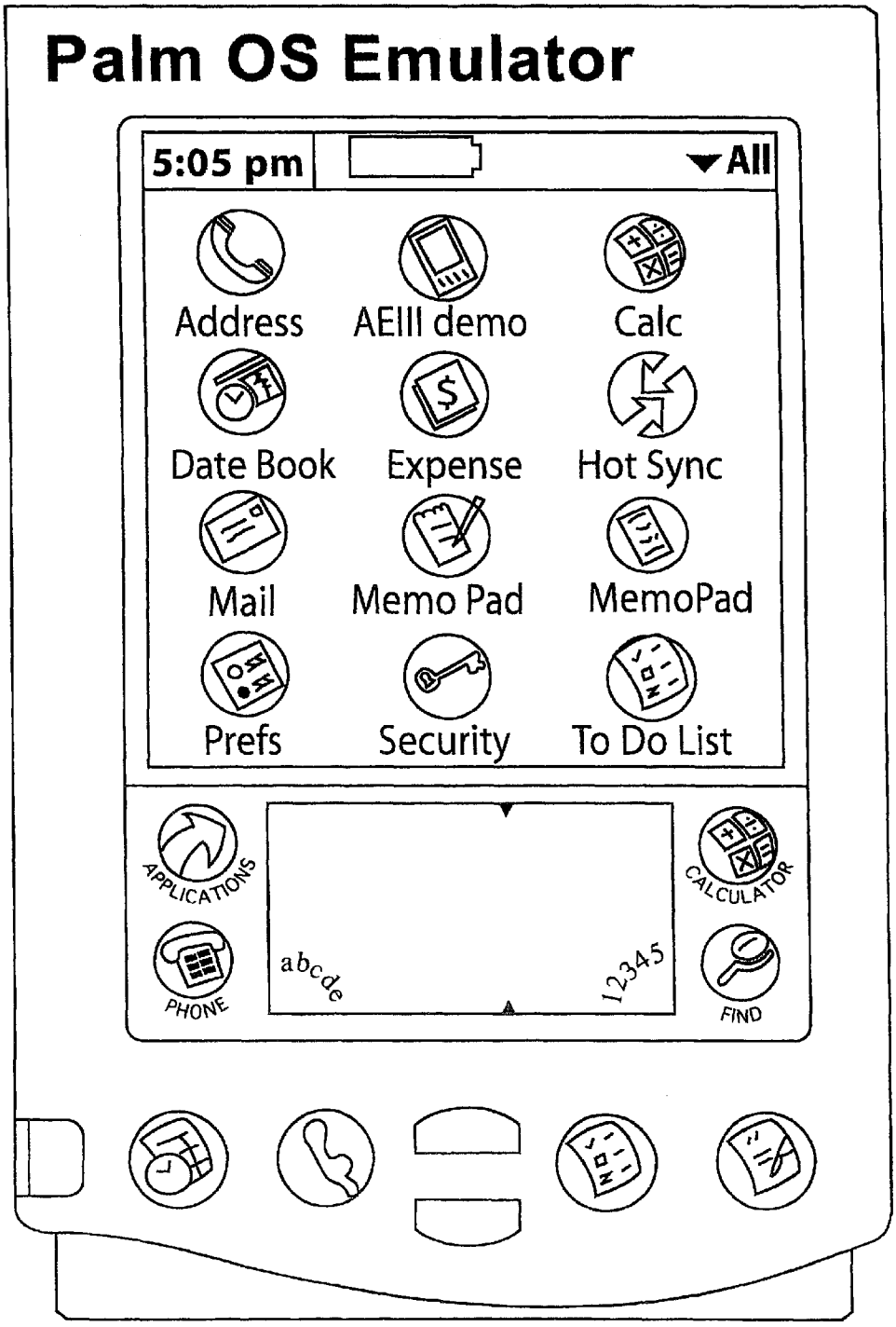
FIGS. 5–18 are views showing screen displays on the key using the new AEIII system.
Figure 6:
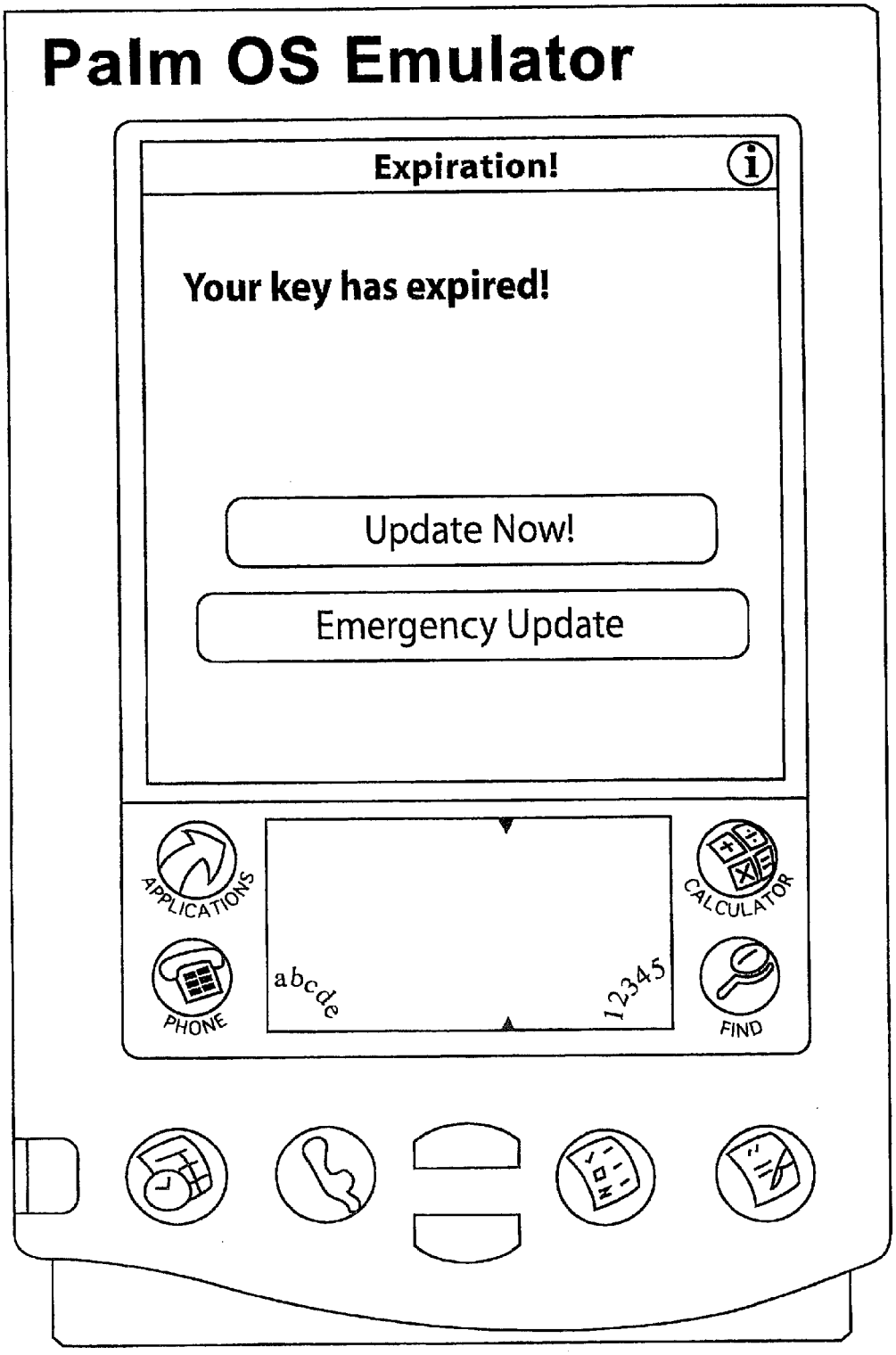

- Keybox operation and information system integrated with:
  - PDA Platform
  - MLS Access Tool
  - Business Communications
  - Agent Productivity Tools
- Immediate visual notification of key status (FIG. 5)
- Emergency update option with Supra hotline support
- Agents cannot continually use hotline for update (FIG. 6)
- Benefits
  - Ensures use of hot sync upload/download
  - Central database integrity is maintained Listing Agent Benefits

Figure 7:
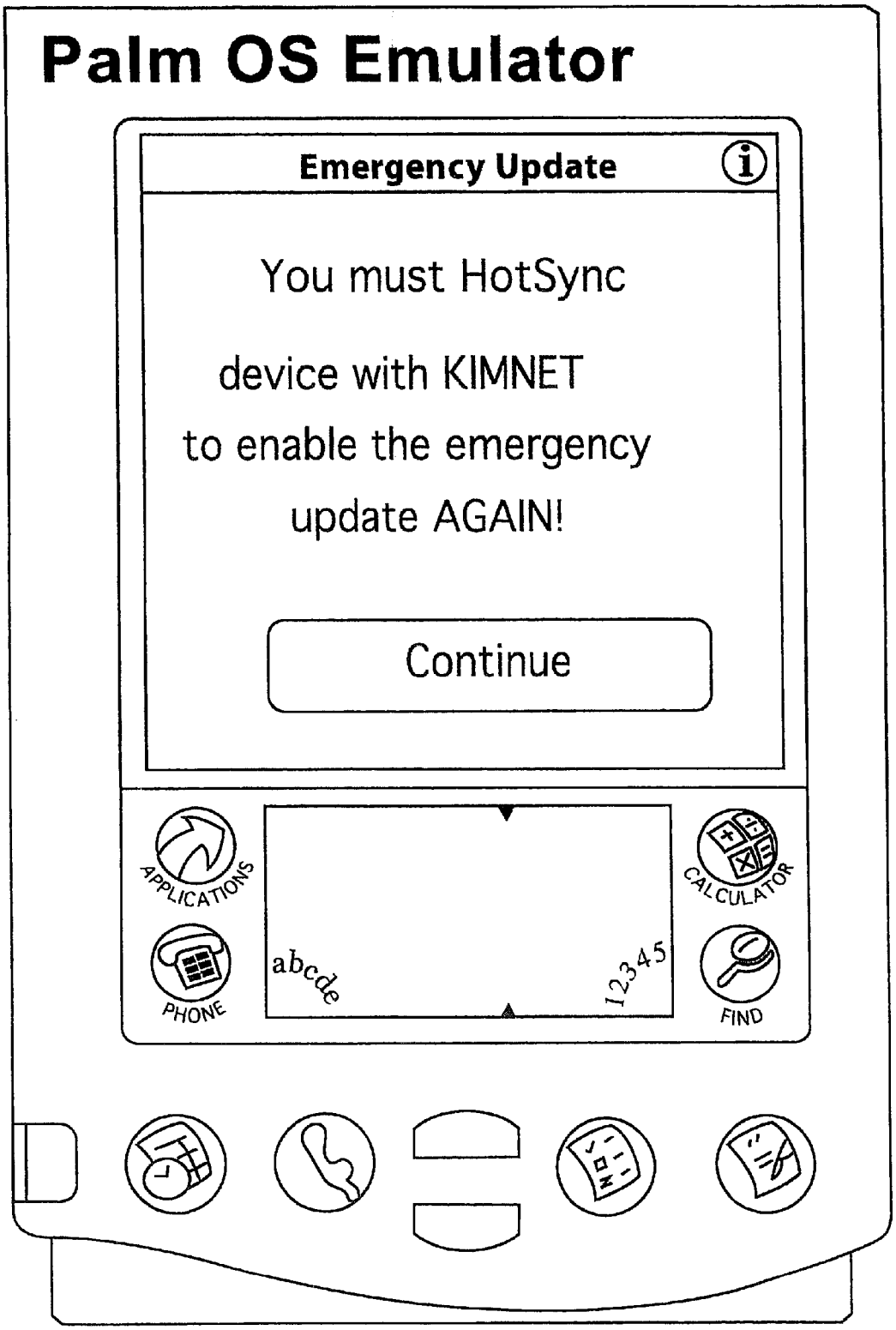

- Automatic daily notification of showings (FIG. 7)
  - Who
  - When
  - Which listing
  - Phone#
- Part of daily hot sync upload/download Agent Benefits

Figure 8:
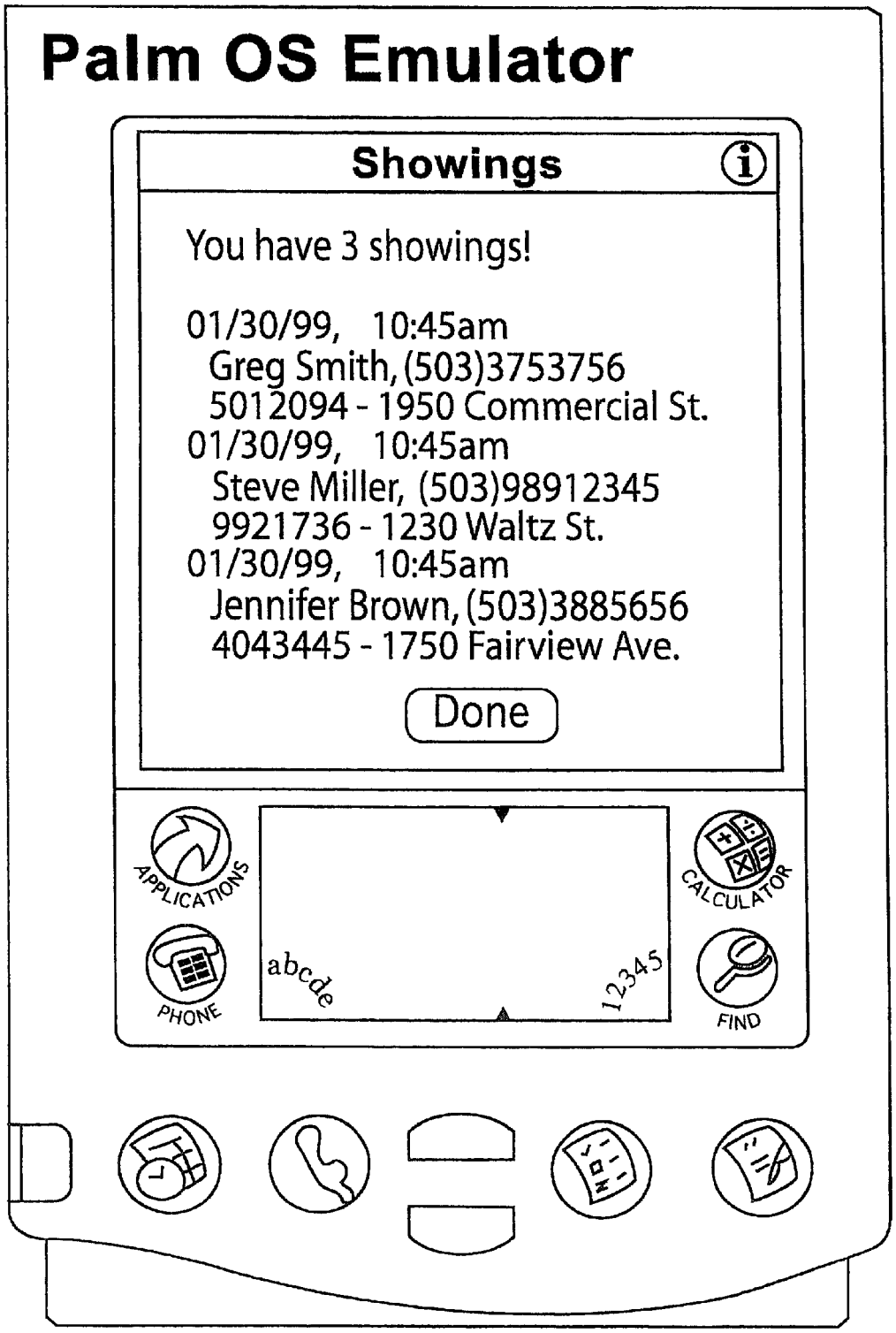
Figure 9:
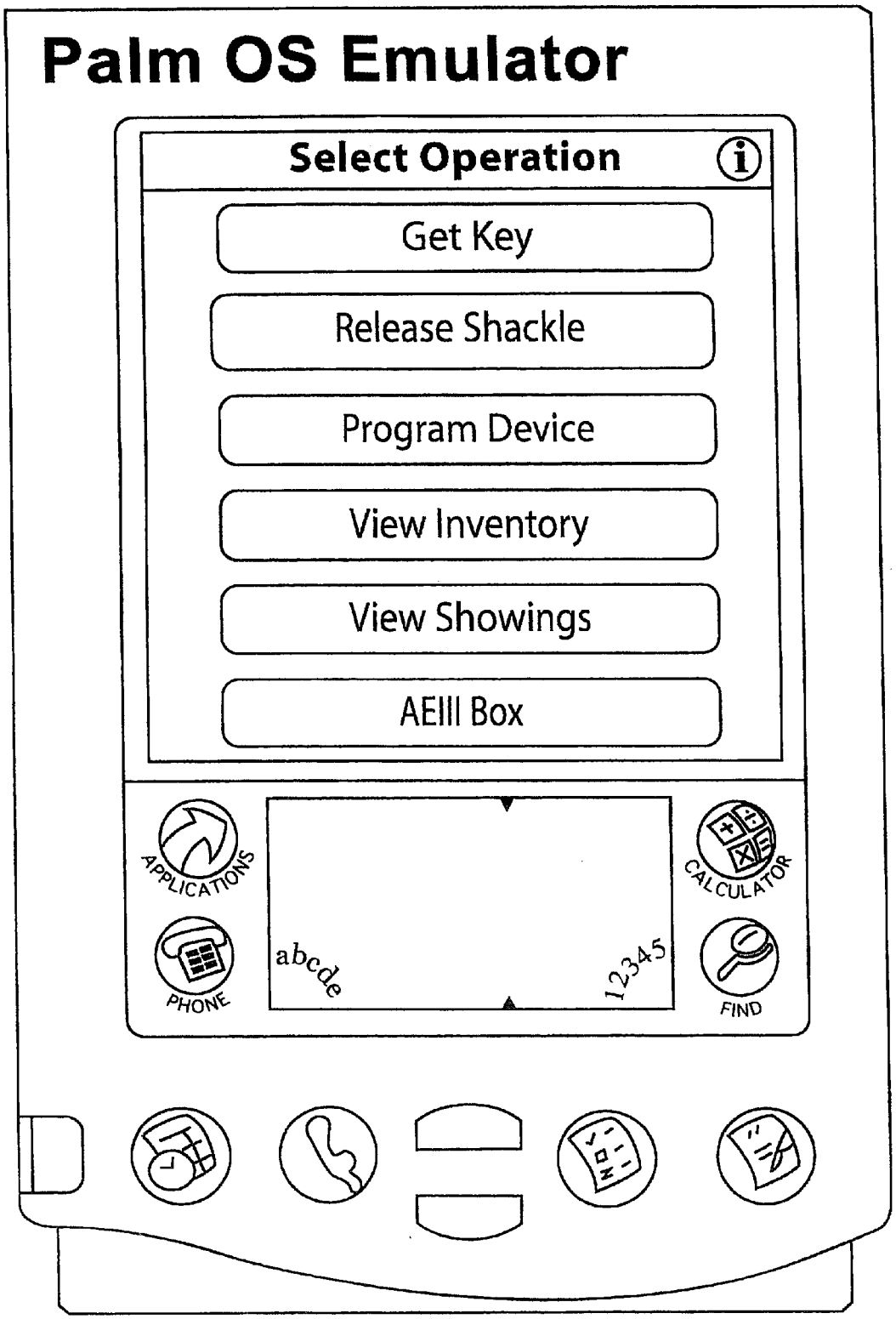
Figure 10:
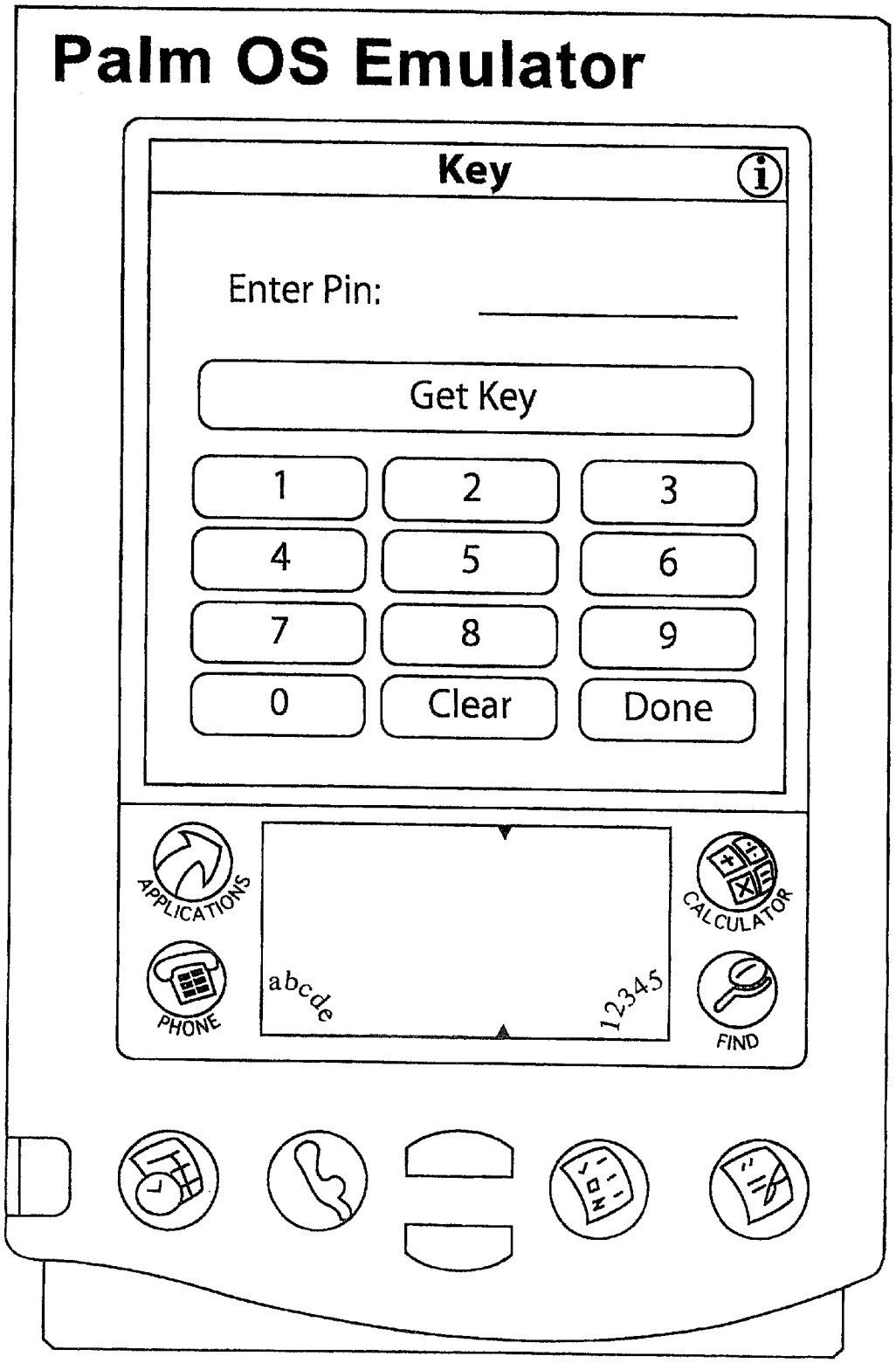
Figure 11:
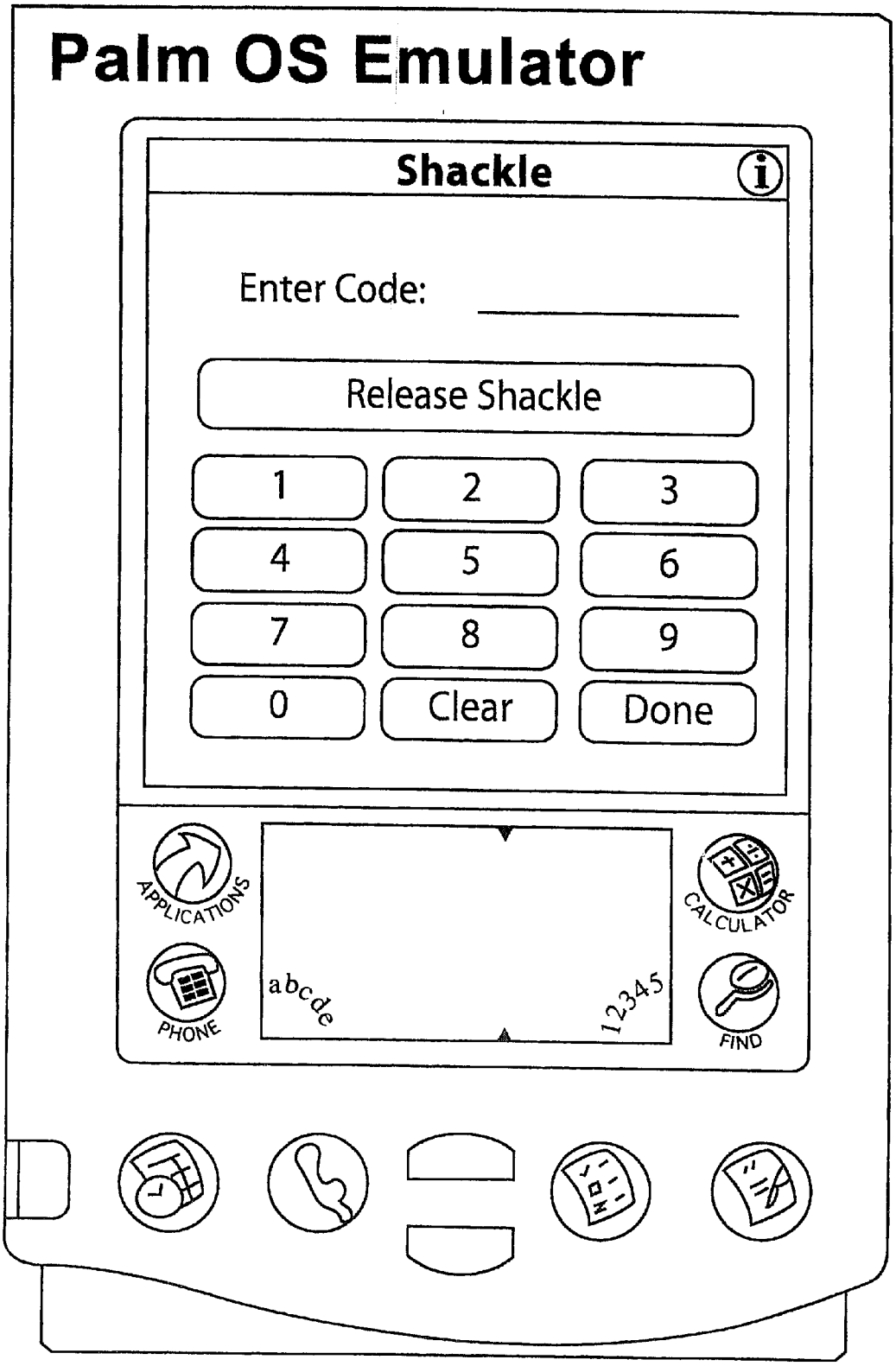

- Multi-function display key (FIGS. 8 and 11)
  - Keybox operations
  - Programming functions
  - Information management
  - Keybox inventory and location, programming
  - Showing activity
- PDA "Key" backward compatable with AEII Keybox (FIGS. 9 and 10)
- Forward enabled for AEIII Keybox
- Operates key container like existing Superkey
- Operates shackle like existing Superkey Listing Agent Benefits

Figure 12:
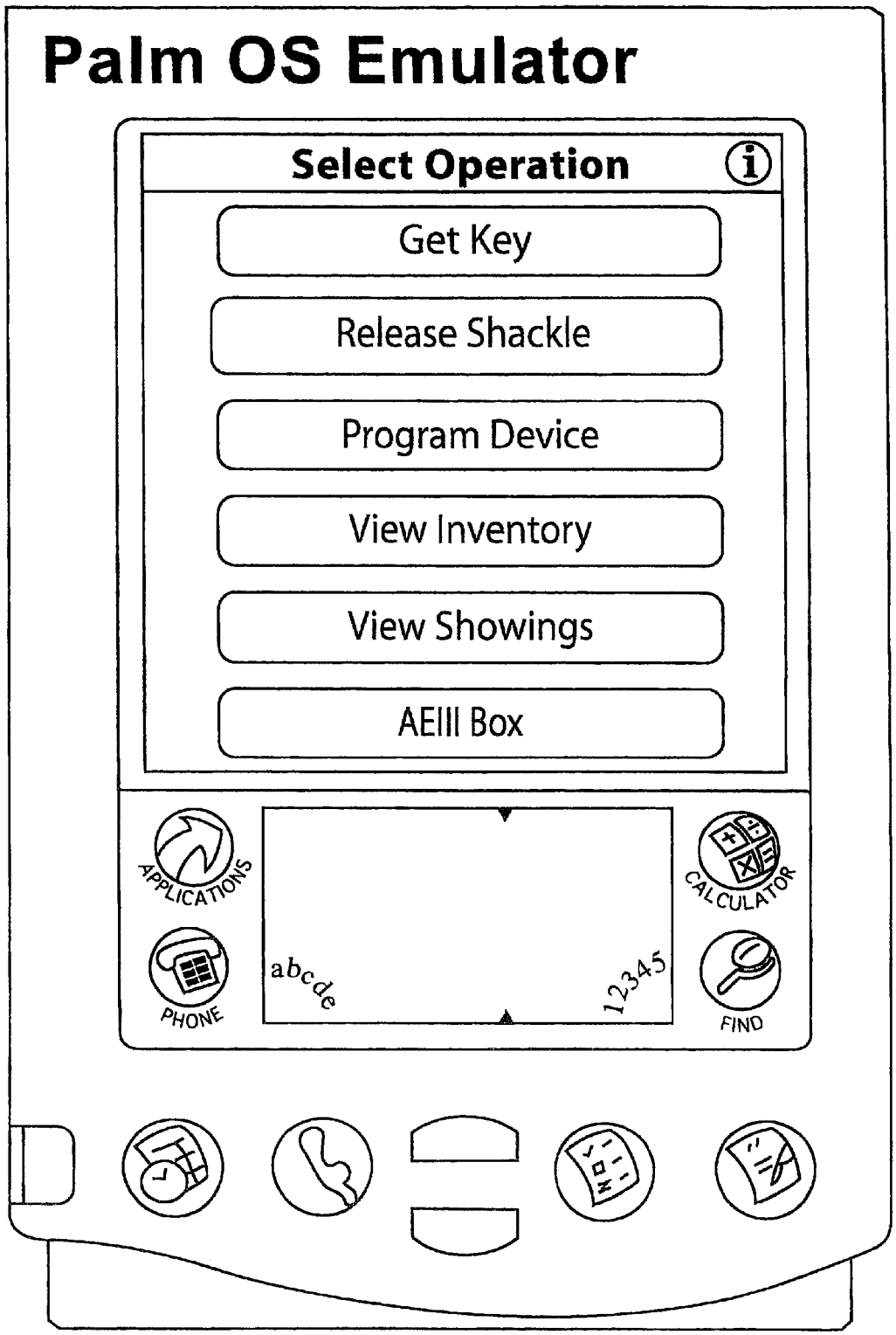
Figure 13:
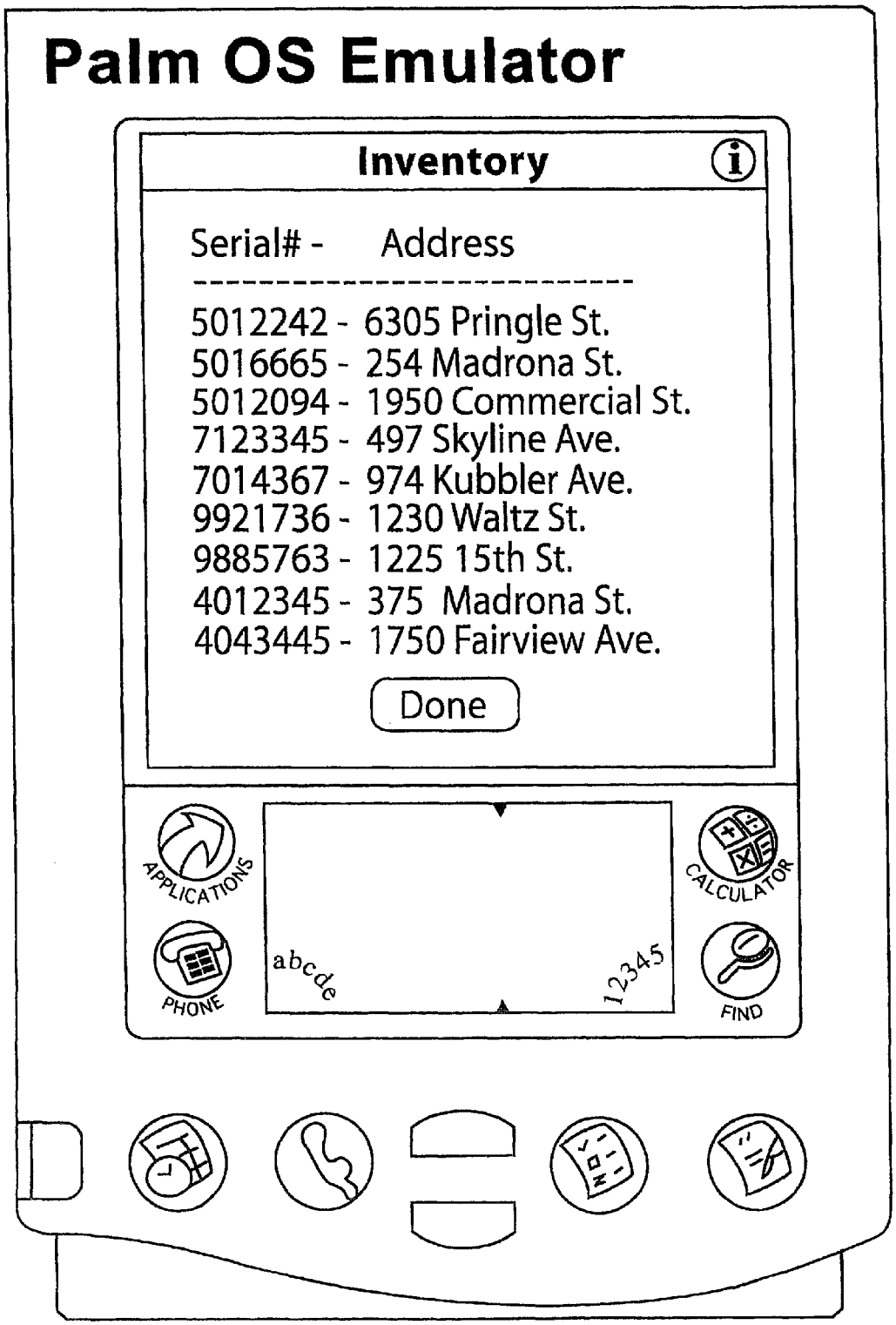

- Database of KeyBox inventory (FIG. 12)
  - Serial number
  - Listing address
- Point and select for KeyBox programming information
- Programming database for each KeyBox (FIG. 13)

Agent Benefits

Figure 14:
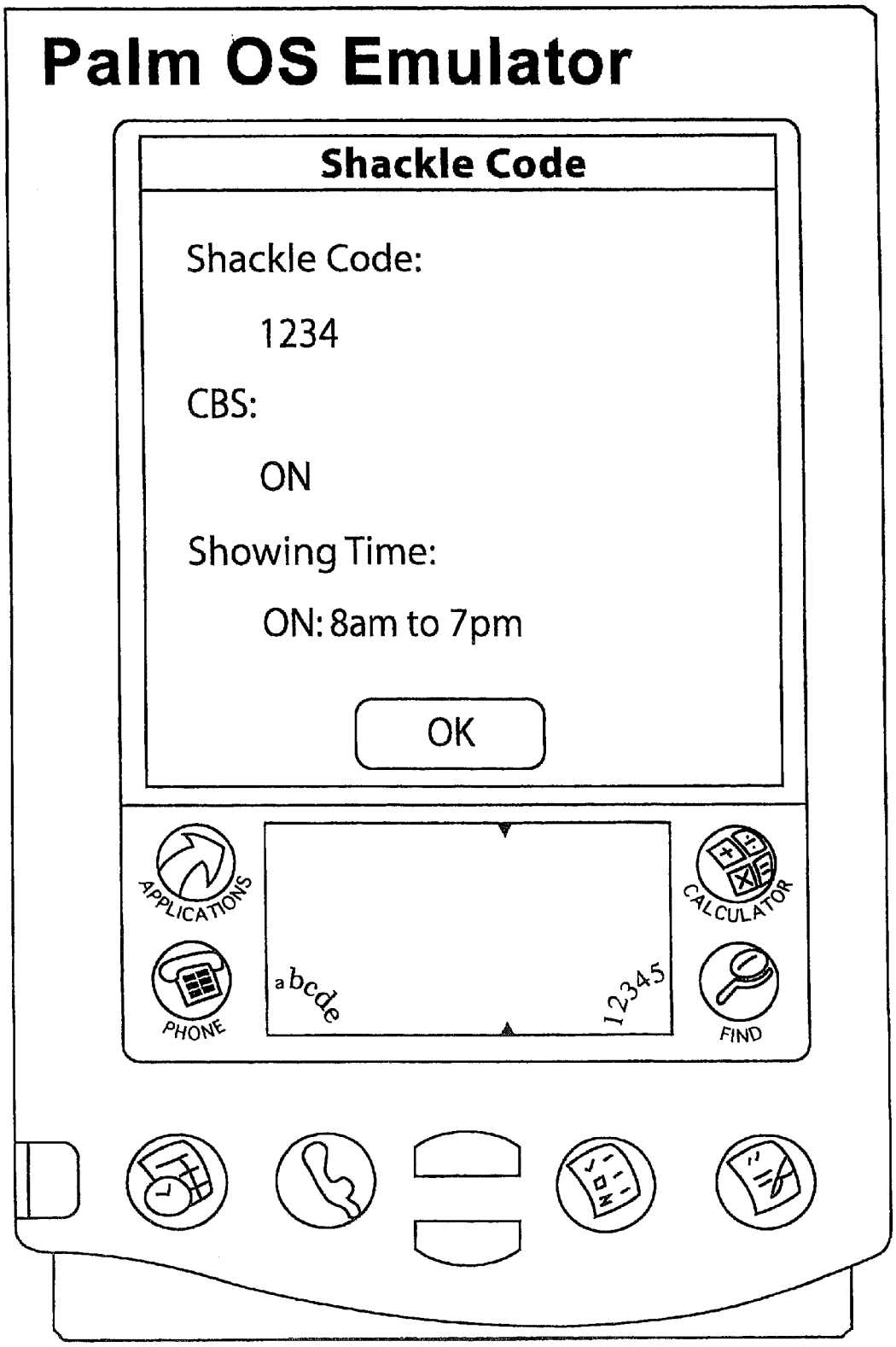
Figure 15:
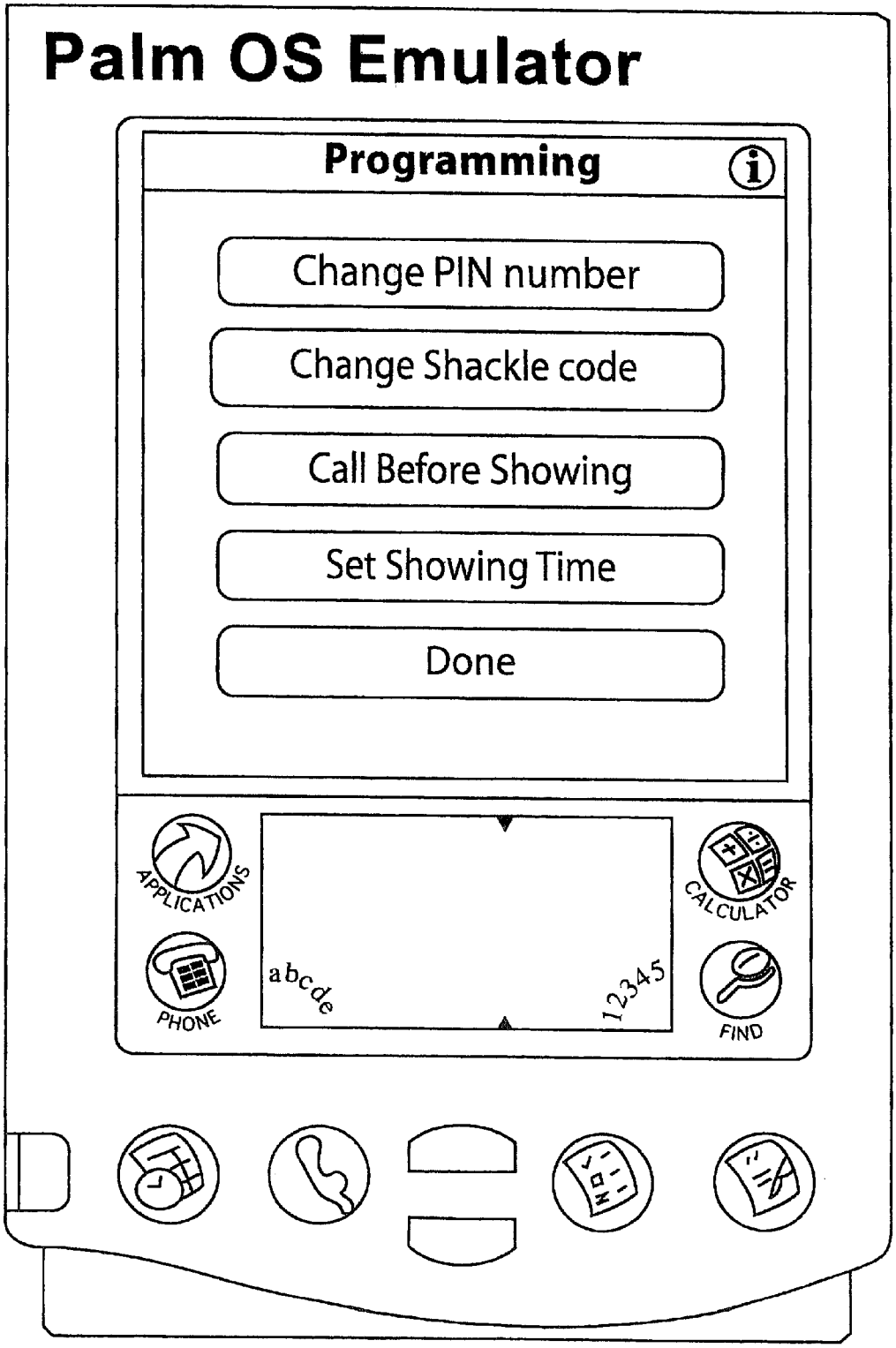

- In-field programming (FIG. 14)
  - No need to travel to Board/MLS for KeyBox or key programming
- Database updated via hot sync upload program
- Agent selectable PIN (FIG. 15)
- KIM database always has current PIN via hot sync upload program Listing Agent Benefits

Figure 16:
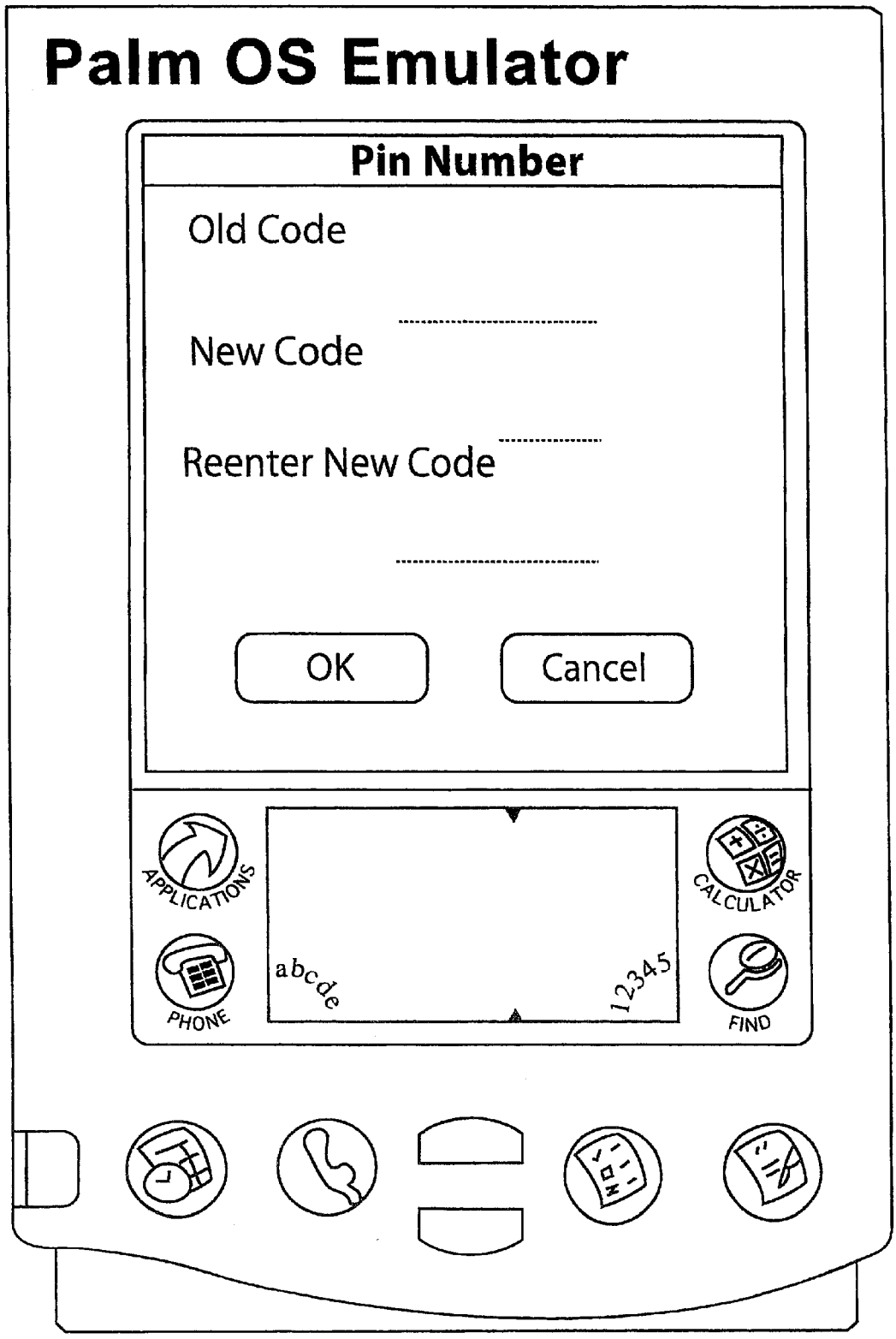
Figure 17:
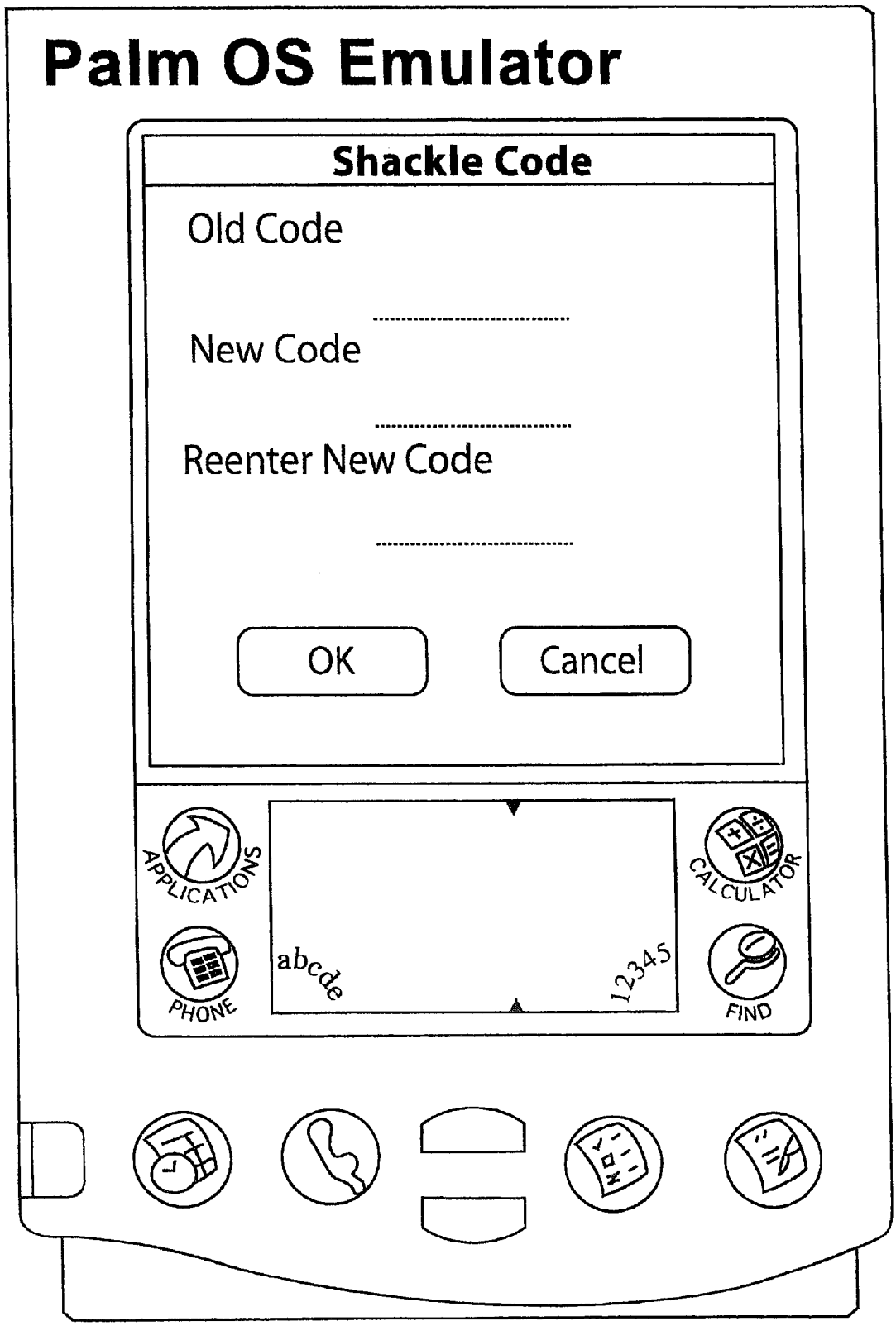
Figure 18:
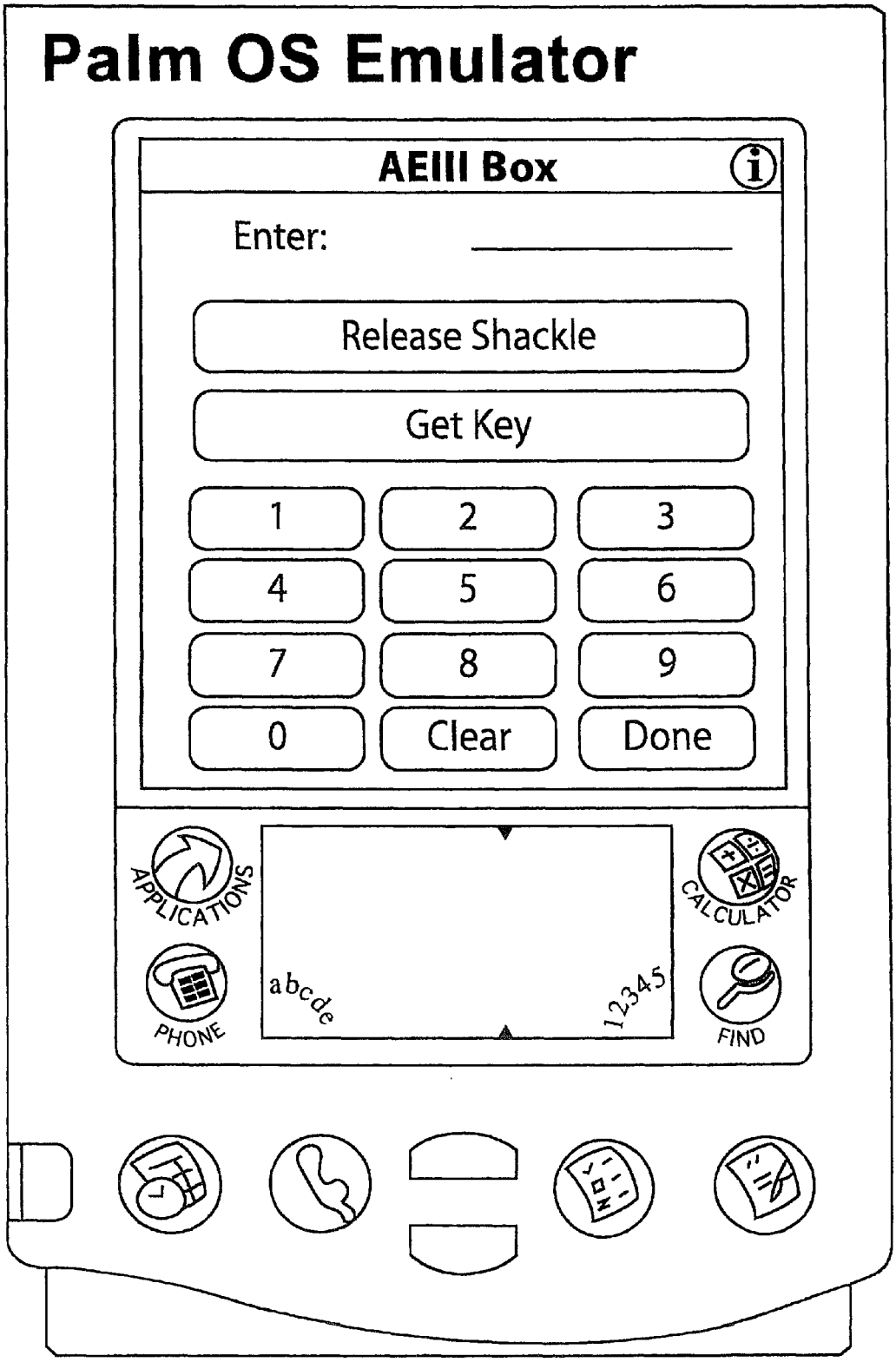

- Changeable shackle code (FIG. 16)
  - All KeyBoxes can be programmed by agent to have the same shackle code
- Changes automatically uploaded to KIM via hot sync upload program Agent Benefits (FIG. 17)

- PDA "key" backward compatible with AEII KeyBox
- Forward enabled for AEIII KeyBox
- Operates like existing SuperKey
- Infrared operation with AEIII Board/MLS System Benefits
- Daily key update
- Broadcast bulletin board to all agents
- Daily showing activity database
- Provide listing information to agents without PC's
- Future UL certified KeyBox
- Long term listing access solution Agent Benefits
- Full PDA key functionality—no upfront cost!
- Automatic update (daily)
- Notification of key status
- Notification of showings
- Automatic showings report
  - PDA display
  - E-mail
- Compatible with AEII KeyBox-AEIII enabled
- Programming of KeyBox (shackle, CBS, Time of Day)
- User selectable PIN
- KeyBox inventory and programming status
- Voice reports at listing Personal Productivity Tools
- Data book
- Address/phone book
- Memo list
- E-mail
- Financial calculator New Solutions Discussion Systems Applications
- MLS information access
- Broker desktop functions Next Generation Comparison

| | AEII | AEIII |
|---|---|---|
| Programmable Features | | |
| Call Before Showing | Board/MLS | Agent |
| Time of Day Lockout | Board/MLS | Agent |
| Shackle code | Board/MLS | Agent |
| PIN code | Board/MLS | Agent |
| Security Features | | |
| Update frequency | Monthly | Daily |
| Update process | Agent calls | Automated |
| PIN protected key | Yes | Yes |
| Key lockout | Possible | Daily |
| Agent tracking | Optional | Automated |
| Report Features | | |
| Non-transmission feedback | None | PDA display |
| Showing report types | Voice/fax | Voice/fax/ internet/MLS |
| Agent activity reports | Possible | Yes |
| New showing alerts | No | Yes |
| Buyers show | No | Yes |
| KeyBox inventory with program options | No | No |

Optional Generation Comparison

| | AEII | AEIII |
|---|---|---|
| Technology Features | | |
| FSK transmission compatible with AEIII KeyBox | Analog | Analog or digital |

-continued

| | AEII | AEIII |
|---|---|---|
| Intrared capability | No | Yes |
| Support future upgrades | No | Yes |
| Communications | KeyBox | Yes |
| | None | Bulletin boards, E-mail |
| Technical Support Features | | |
| Online help | No | Yes |
| Automated troubleshooting | Yes | Yes |
| Hotline 800 support | Yes | Yes |
| Personal Productivity Tools | | |
| Data book | No | Yes |
| Address/phone book | No | Yes |
| Memo list | No | Yes |
| E-mail | No | Yes |
| Financial Calculator | | |
| MLS Access Features | | |
| Agents personal listings | No | Yes |
| Custom listing profiles (farm) | No | Yes |
| Display of listing stats for buyer | No | Yes |
| Listing hot sheet notification | No | Yes |
| Bulletin board communication | No | Yes |
| Office listings | No | Yes |
| Quick search (on demand) of comparative homes | No | Yes |

Optional Service Levels
- Gold Level
  - Palm 5 PDA
  - Keybox Functions
  - Message Board
  - Personal Listing with content
  - Office Listings
  - Tegris Reflex Desktop
- Platinum Level
  - Hot Sheet Listings
  - Personal Farming Profile
  - Quick Search (MLS)
  - Internet Services
  - Content Services
    - Interest Rates
    - Weather
    - Stock Market Information
  - Transaction Status
  - Street Mapping (As used herein, "palmtop" is meant to refer to any portable, microprocessor-based device, including palmtop computers, notebook computers, personal digital assistants, and dedicated microprocessor-based key units) is used as an access control device for electronic lock devices. A "general purpose palmtop" is meant to refer to a palmtop which is not dedicated to access control tasks exclusively.)

To provide a comprehensive disclosure without unduly lengthening this specification, applicants incorporate by reference the patents and commonly-owned applications referenced herein.

Having described an illustrated the principles of our invention with reference to an illustrative embodiment, it will be recognized that the invention can be modified in arrangement and detail without departing from such principles. Accordingly, we claim as our invention all such modifications as fall within the scope and spirit of the following claims, and equivalents thereto.

We claim:

1. In a key for an electronic lock, the lock having a physical interface with which the key is designed to mechanically interact, an improvement wherein the key is a general purpose personal digital assistant device that has been modified to provide a physical interface for interacting with the physical interface of the lock and has a display capable of displaying at least characters and of displaying a soft key operable by a user, said device being adapted to provide unlocking signals to the lock, wherein the functionality of an electronic key is provided with that of a personal digital assistant.

2. A key for use with an electronic lock having a mechanical interface shaped to receive at least a portion of the key, the key comprising:

a general purpose personal digital assistant (PDA) programmed to selectively transmit electrical signals to unlock the lock, the PDA having a display capable of displaying at least characters and of displaying a soft key operable by a user; and a mechanical interface attached to and electrically coupled to the personal digital assistant, the mechanical interface receiving the electrical unlocking signals from the PDA and conveying the electrical signals to the lock when the key is engaged with the lock.

3. The key of claim 2, wherein the PDA has a circuit terminating in an external electrical connection through which the electrical signals from the PDA are transmitted, and the mechanical interface has a conductor with a first end connected to the external electrical connection and a second end connectible to the lock, and wherein when the key is coupled to the lock with the second end connected to the lock, the electrical signals from the PDA can be selectively transmitted from the PDA to the lock through the external electrical connection and the conductor.

4. A secure entry system for securing an area and allowing the area to be selectively accessed by authorized individuals, comprising:

an electronic lock positioned to secure the area if locked and to allow access to the area if unlocked, the lock having a lock physical interface;

an electronic key operable to selectively transmit unlocking signals from the key to the lock by direct electrical contact to cause the lock to change from locked state to an unlocked state, the electronic key having additional functionality as a general purpose personal digital assistant that includes a display capable of displaying at least characters and of displaying a soft key operable by a user; and a key physical interface physically and electrically coupled to the electronic key, the key physical interface being shaped to cooperate with the lock physical interface, wherein the key physical interface transmits electrical signals between the coupled key and the lock when the key physical interface and coupled key are positioned in a cooperative relationship with the lock physical interface and the key is operated.

5. The system of claim 4, wherein the display is capable of displaying a text message regarding interaction between the electronic key and electronic lock.

6. The system of claim 4, wherein the display is capable of displaying a text message providing instructions to a user seeking to access the electronic lock.

7. The system of claim 4, wherein the display is capable of displaying a text message providing an indication that the PDA has received a communication.

8. The system of claim 4, wherein the display is capable of displaying an array of soft keys individually operable to enter numerals.

9. A method of providing authorized access to an area secured by a secure entry system, the secure entry system having an electronic lock positioned to secure the area, an electronic key operable to unlock the lock and having additional functionality as a personal digital assistant, the key having an attached mechanical interface shaped to couple with the electronic lock and a display capable of displaying a soft key operable by a user, the method comprising:

coupling the mechanical interface to the electronic lock such that the electronic key is in direct electrical contact with the electronic lock via the mechanical interface;

operating the soft key of the key display to begin an unlocking sequence in which a text message is displayed on the key; and receiving user input entered via the key.

10. The method of claim 9, further comprising verifying that access is authorized based on the received user input.

11. The method of claim 9, further comprising decoupling the key and mechanical interface from the electronic lock and using the key as a personal digital assistant.

* * * * *

UNITED STATES PATENT AND TRADEMARK OFFICE

CERTIFICATE OF CORRECTION

PATENT NO. : 6,937,140 B1
APPLICATION NO. : 09/312919
DATED : August 30, 2005
INVENTOR(S) : John Steven Outslay et al.

It is certified that error appears in the above-identified patent and that said Letters Patent is hereby corrected as shown below:

Column 1, lines 49-50, “above-noted the” should read --above-noted, the--.

Column 2, line 20, “alternative embodiment” should read --alternative embodiments--.

Column 3, lines 58-59, “central clearing house” should read --central clearinghouse--.

Column 3, line 60, “clearing house” should read --clearinghouse--.

Column 4, line 2, “AEII” should read --AEIII--.

Column 4, line 44, “display)<if” should read --display) if--.

Column 6, line 21, “timeframe than at” should read --timeframe that an--.

Column 7, line 39, “helpful hits” should read --helpful hints--.

Column 9, line 5, “PC's” should read --PCs--.

Column 10, line 5, “Intrared capability” should read --Infrared capability--.

Column 10, line 49, “(As” should read --As--.

Column 10, line 52, “units) is” should read --units--.

Column 10, line 55, “exclusively.)” should read --exclusively.--.

Column 10, line 61, “an illustrated” should read --and illustrated--.

Signed and Sealed this

Fourteenth Day of August, 2007

JON W. DUDAS
*Director of the United States Patent and Trademark Office*